US009375039B2

(12) United States Patent
Etheridge

(10) Patent No.: US 9,375,039 B2
(45) Date of Patent: Jun. 28, 2016

(54) INTERCHANGEABLE TIE

(71) Applicant: Brandon William Etheridge, Waxhaw, NC (US)

(72) Inventor: Brandon William Etheridge, Waxhaw, NC (US)

( * ) Notice: Subject to any disclaimer, the term of this patent is extended or adjusted under 35 U.S.C. 154(b) by 0 days.

(21) Appl. No.: 14/300,620

(22) Filed: Jun. 10, 2014

(65) Prior Publication Data

US 2015/0096101 A1 Apr. 9, 2015

Related U.S. Application Data

(63) Continuation-in-part of application No. 29/469,016, filed on Oct. 4, 2013.

(60) Provisional application No. 61/887,307, filed on Oct. 4, 2013.

(51) Int. Cl.

| | |
|---|---|
| ***A41D 25/06*** | (2006.01) |
| ***A41D 25/04*** | (2006.01) |
| ***A41D 25/00*** | (2006.01) |

(52) U.S. Cl.

CPC ..... *A41D 25/06* (2013.01); *A41D 25/005* (2013.01); *Y10T 24/19* (2015.01)

(58) Field of Classification Search

CPC ..... A41D 25/00; A41D 25/001; A41D 25/02; A41D 25/04; A41D 25/16; A41D 25/08

USPC ..... 2/144–147, 151, 152.1, 207, 137, 148

See application file for complete search history.

(56) References Cited

U.S. PATENT DOCUMENTS

| | | | | | |
|---|---|---|---|---|---|
| 1,704,422 | A * | 3/1929 | Belunes | 24/50 | |
| 1,720,009 | A * | 7/1929 | Sherman | 2/151 | |
| 2,565,149 | A * | 8/1951 | Shea | 2/153 | |
| 2,834,967 | A * | 5/1958 | Taksa | 2/155 | |
| 3,142,844 | A * | 8/1964 | Murray | A41F 3/00 2/310 | |
| 3,439,360 | A * | 4/1969 | Grubman | 2/155 | |
| 4,610,037 | A * | 9/1986 | Haymer | 2/145 | |
| 5,003,636 | A * | 4/1991 | Marostica | 2/145 | |
| 5,165,112 | A * | 11/1992 | Dawes | 2/150 | |
| 5,216,757 | A * | 6/1993 | Dorkin | 2/152.1 | |
| 5,235,704 | A * | 8/1993 | Collins | 2/155 | |
| 5,322,037 | A * | 6/1994 | Tozawa | 119/865 | |
| 5,507,076 | A * | 4/1996 | Anscher | 24/625 | |
| 5,600,851 | A * | 2/1997 | McLeod | 2/144 | |
| 5,600,852 | A * | 2/1997 | Densch | 2/144 | |
| D388,238 | S * | 12/1997 | LaBorde et al. | D2/609 | |
| 5,715,538 | A * | 2/1998 | Soll | 2/145 | |
| 5,774,893 | A * | 7/1998 | Torres | 2/148 | |
| 5,778,453 | A * | 7/1998 | Chen | 2/148 | |
| 5,881,383 | A * | 3/1999 | Perkins | 2/144 | |
| 6,205,586 | B1 * | 3/2001 | Jenkins et al. | 2/145 | |
| 6,205,587 | B1 * | 3/2001 | Shiffler | 2/146 | |
| 6,209,136 | B1 * | 4/2001 | Ophardt | 2/145 | |
| 6,526,590 | B2 * | 3/2003 | Tierney | 2/144 | |

(Continued)

*Primary Examiner* — Robert J Hicks
*Assistant Examiner* — Timothy K Trieu
(74) *Attorney, Agent, or Firm* — Darryl W. Shorter

(57) ABSTRACT

A method for assembling a bow tie comprising inserting a first end of a link into an receiving end of a first strap portion of a first interchangeable tie section, the first interchangeable tie section including the first strap portion and a first leaf portion, selecting a second interchangeable tie section, the second interchangeable tie section including a second strap portions and a second leaf portion, the second strap portion including a receiving end, and inserting a second end of the link into the receiving end of the second strap portion.

8 Claims, 6 Drawing Sheets

(56) References Cited

U.S. PATENT DOCUMENTS

| | | | | |
|---|---|---|---|---|
| 7,698,748 | B2 * | 4/2010 | Kim | 2/144 |
| 7,757,306 | B2 * | 7/2010 | Mattioli | 2/144 |
| D668,836 | S * | 10/2012 | Martin | D2/605 |
| D671,709 | S * | 12/2012 | Cicerchia et al. | D2/605 |
| 2004/0210977 | A1 * | 10/2004 | Smalls | 2/144 |
| 2005/0015845 | A1 * | 1/2005 | Bostwick et al. | 2/144 |
| 2005/0178156 | A1 * | 8/2005 | McMahon | A44C 15/005 63/35 |
| 2006/0191055 | A1 * | 8/2006 | Mattioli | 2/144 |
| 2006/0282935 | A1 * | 12/2006 | Namiki | 2/144 |
| 2010/0050318 | A1 * | 3/2010 | Johnston | 2/148 |
| 2010/0175233 | A1 * | 7/2010 | Breeden et al. | 24/68 CD |
| 2013/0269083 | A1 * | 10/2013 | Paglione | 2/145 |

* cited by examiner

INTERCHANGEABLE TIE

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention relates to a tie. More specifically, the present invention relates to an interchangeable tie.

Consumers desire to be able to show their individuality through fashion. A tie is one of the ways in which an individual can make such a statement. Currently, a tie is purchased as a single unit, such that only one color or pattern can be worn for each tie purchased.

As it relates to bow ties, bow ties are being made that have different patterns on the front and back of the bow tie, or a different pattern on each half of the bow tie. Even with different patterns, a wearer must purchase additional whole bow ties in order to increase the variety in his/her wardrobe.

There currently is no way for a consumer to mismatch ties, i.e., take a pattern from one tie and match it with another pattern from another tie.

Accordingly, there exists a need for an improved bow tie.

SUMMARY OF THE INVENTION

The present invention includes many aspects and features. Moreover, while many aspects and features relate to, and are described in the context of bow ties, the present invention is not limited to use only in this context, as will become apparent from the following summaries and detailed descriptions of aspects, features, and one or more embodiments of the present invention.

Accordingly, one aspect of the present invention relates to a method for assembling a bow tie comprising inserting a first end of a link into an receiving end of a first strap portion of a first interchangeable tie section, the first interchangeable tie section including the first strap portion and a first leaf portion, selecting a second interchangeable tie section, the second interchangeable tie section including a second strap portions and a second leaf portion, the second strap portion including a receiving end, and inserting a second end of the link into the receiving end of the second strap portion.

In a feature of this aspect, the receiving end of each of the first and second strap portions of the first and second interchangeable tie sections have a loop for receiving the first and second ends respectively of the link.

In another feature of this aspect, the first and second strap portions include an adjusting clip for adjusting a length of each first and second strap portion.

In another feature of this aspect, the link is a S shaped fastener.

In another feature of this aspect, each of the first and second interchangeable tie sections are each a half of a bowtie.

In another feature of this aspect, the first and second interchangeable tie sections are connected by the link, such that when the bow tie is tied, the first and second leaf portions of the first and second interchangeable tie sections is one of a front leaf panel and back leaf panel respectively of the tied bow tie.

Another aspect of the present invention relates to a bow tie comprising a first interchangeable tie section including the first strap portion and a first leaf portion, a second interchangeable tie section including a second strap portion and a second leaf portion, and a link having a first end for attaching to the first strap portion of the first interchangeable tie section and a second end for attaching to the second strap portion of the second interchangeable tie section.

In a feature of this aspect, the first strap portion of the first interchangeable tie section includes a receiving end for receiving the first end of the link and the second strap portion of the second interchangeable tie section includes a receiving end for receiving the second end of the link.

In another feature of this aspect, the receiving end of each of the first and second interchangeable tie sections is configured to be a loop.

In another feature of this aspect, the first end of the link is inserted into the loop of the receiving end of the first interchangeable tie section, and the second end of the link is inserted into the loop of the receiving end of the second interchangeable tie section.

In another feature of this aspect, the first and second strap portions include an adjusting clip for adjusting a length of each first and second strap portion.

In another feature of this aspect, the link is a S shaped fastener.

In another feature of this aspect, each of the first and second interchangeable tie sections are each a half of a bowtie.

In another feature of this aspect, the first and second interchangeable tie sections are connected by the link, such that when the bow tie is tied, the first and second leaf portions of the first and second interchangeable tie sections is one of a front leaf panel and back leaf panel respectively of the tied bow tie.

Another aspect of the present invention relates to an interchangeable tie section comprising a leaf portion, and a strap portion having a receiving end for receiving an end of a link.

In a feature of this aspect, the receiving end is configured to be a loop.

In another feature of this aspect, the end of the link is inserted into the loop of the receiving end.

In another feature of this aspect, the strap portion includes an adjusting clip for adjusting a length of the strap portion.

In another feature of this aspect, the link is a S shaped fastener.

In another feature of this aspect, the tie section is a half of a bow tie.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1:
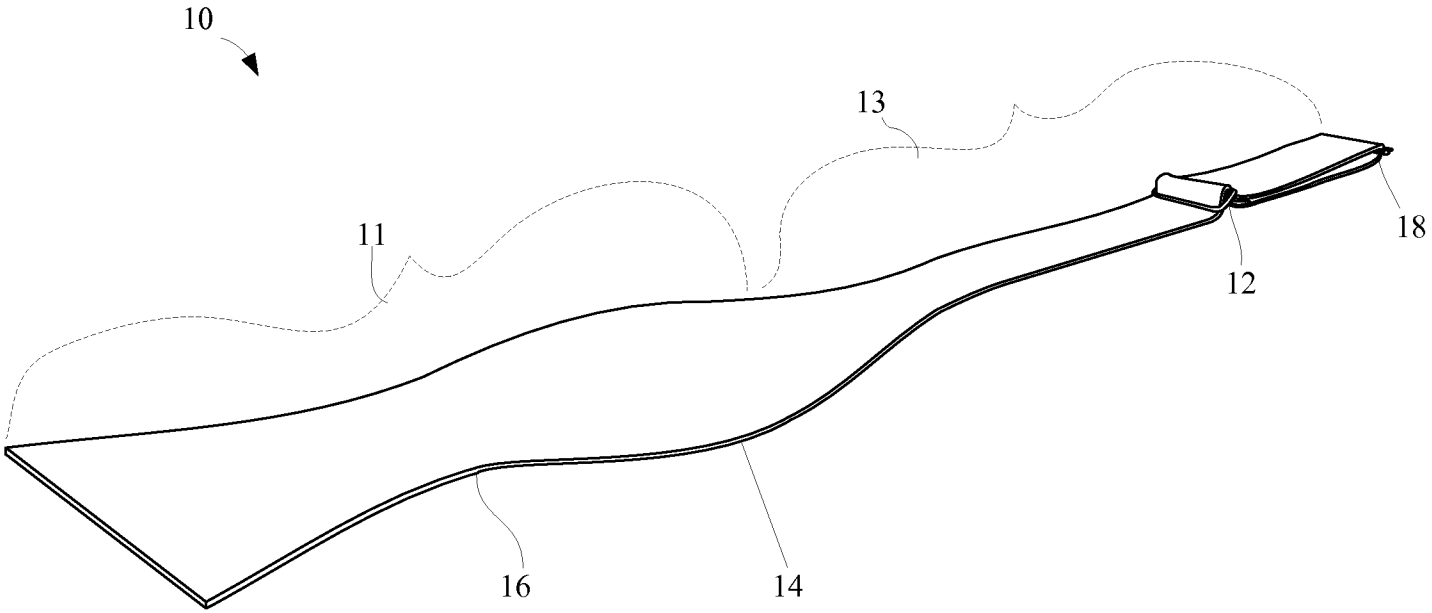
FIG. 1 is an example illustration of a front perspective view of a disclosed implementation of an interchangeable tie section in accordance with the present invention.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed; to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

The following description of one or more preferred embodiments is merely exemplary in nature and is in no way intended to limit the invention, its implementations, or uses.

Interchangeable tie sections are disclosed that allow a wearer to assemble a bow tie using two interchangeable tie sections, resulting in the wearer increasing the number of bow ties available for his/her wardrobe without having to purchase multiple whole bow ties.

An example illustration of an implementation of a disclosed tie section is shown in FIG. 1. The tie section 10 includes a leaf portion 11 and a strap portion 13. As illustrated in FIG. 1, the tie section 10 is a bow tie half. As those having skill in the art know, the tie section is preferably a length of double thickness fabric with concealed seams as used in prior art bow ties.

The leaf portion 11 of the tie section 10 includes a neck 16 and a leaf 14. The shape of the leaf 14 and the bow proportions as illustrated are for example purposes only and are not meant to limit the disclosed interchangeable tie sections.

Figure 2:
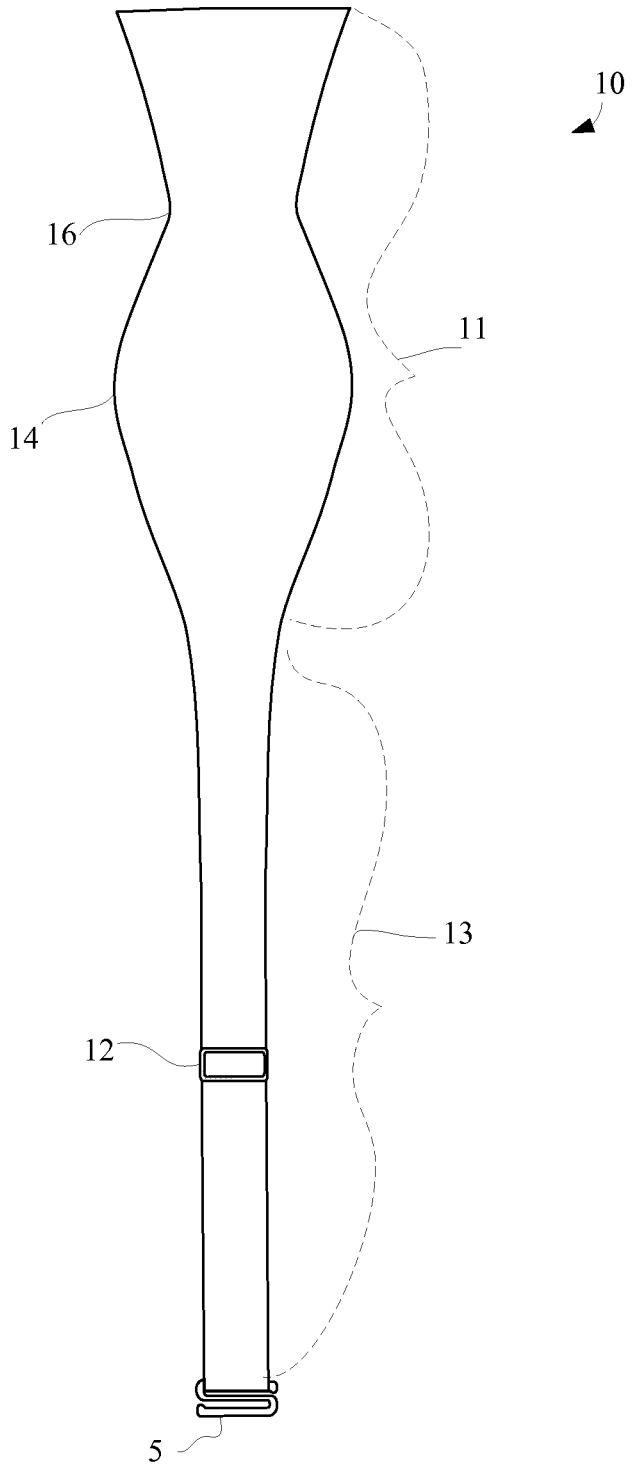
FIG. 2. is an example illustration of a top view of the tie section of FIG. 1.

The strap portion 13 includes a receiving end 18 wherein a connecting link 5, illustrated in FIG. 2 is able to be attached to the strap portion 13 receiving end 18. The receiving end 18 illustrated in FIG. 1 is a loop that allows one end of the connecting link 5 to be inserted therein to maintain the connecting link's 5 attachment to the tie section 10.

The connecting link 5, as shown, is a S shaped fastener that allows the fastener to be attached at both ends. Although an S shaped clip/fastener has been illustrated, any fastener may be used that allows the ends of more than one disclosed tie section to be fastened together, for example, a snap, Velcro, s-clip, ring, etc., such that any two tie sections can be coupled to create a bow tie. In accordance with the disclosed implementation, the connecting link is not associated with any one tie section, and is therefore interchangeable between tie sections. This interchangeability of the connecting link ensures that any tie section may be coupled to any other tie section, as disclosed below.

The strap portion 13, preferably, further includes an adjusting clip 12. The adjusting clip 12 allows the length of the strap portion 13 of the tie section 10 to be made smaller or larger to fit a particular wearer.

Figure 3:
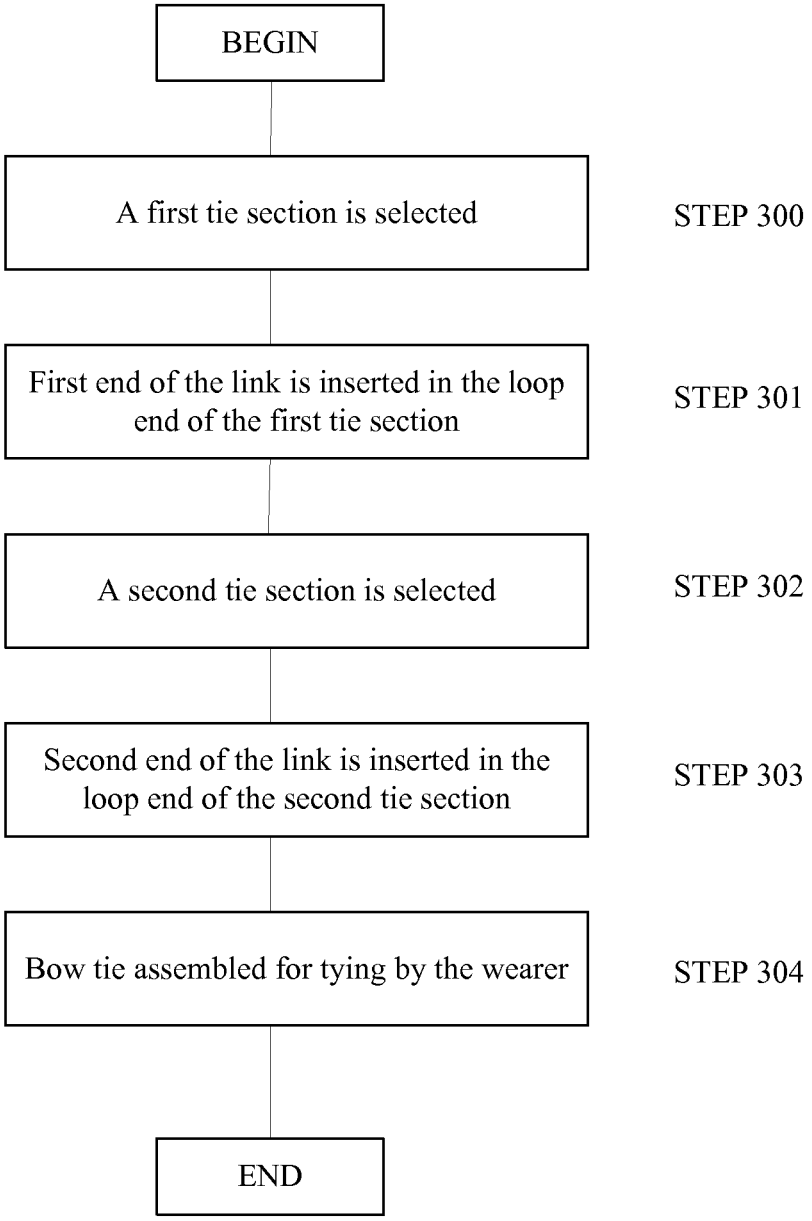
FIG. 3 is an example flow diagram of a method for assembling a bow tie including the disclosed interchangeable tie section in accordance with the present invention.

An example flow diagram of an implementation of a method for assembling a full bow tie using the disclosed interchangeable tie sections is illustrated in FIG. 3. A first tie section is selected by a wearer. STEP 300. A first end of a connecting link is attached to the receiving end of the first tie section. STEP 301. The wearer then selects a second tie section to couple to the first tie section. STEP 302. The second end of the connecting link is then attached to the receiving end of the second tie section. STEP 303. The wearer may then tie the two interchangeable tie sections (i.e., the two bow tie halves) into a tied bow tie. STEP 304. An example of the assembled bow tie in accordance with the disclosed implementation is illustrated in FIG. 4.

Figure 4:
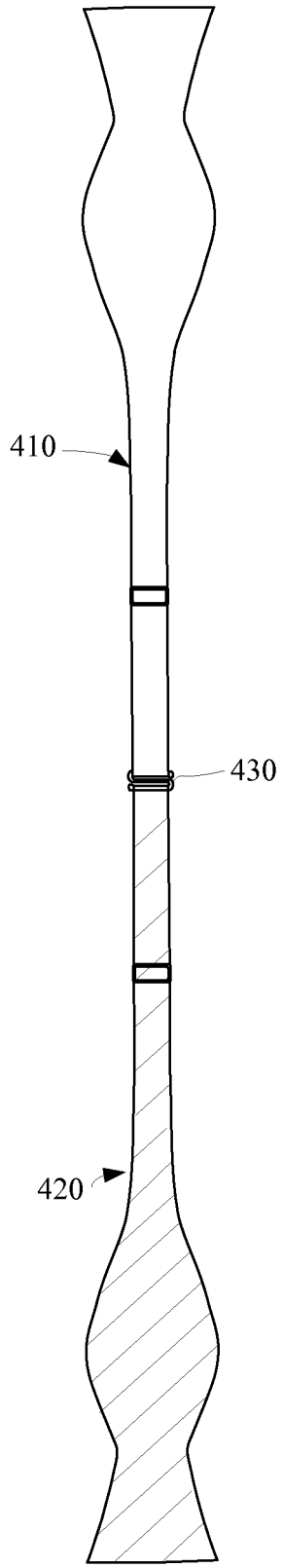
FIG. 4 is an example illustration of the assembled bow tie including first and second interchangeable tie sections in accordance with the present invention.

In the illustrated example of FIG. 4, the assembled bow tie 400 includes the first interchangeable tie section 410 and second interchangeable tie section 420 coupled together by the connecting link 430. As illustrated, interchangeable first tie section 410 may be a different pattern than the pattern of the interchangeable tie section 420. As disclosed above, each tie section is fully interchangeable with any other tie section in accordance with the disclosed implementation.

Figure 5:
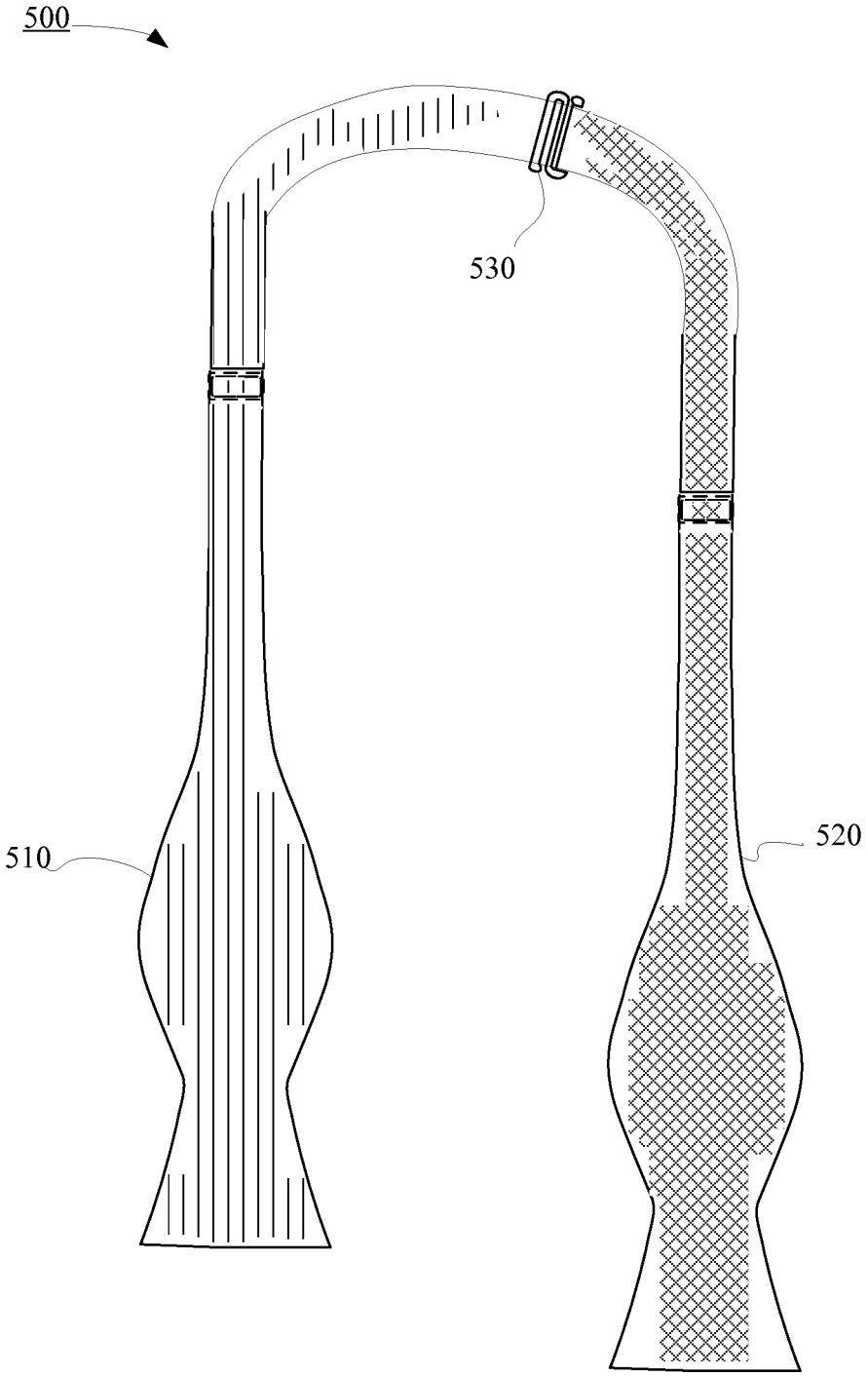
FIG. 5 is an example illustration of the assembled bow tie including first and second interchangeable tie sections having different patterns thereon.
Figure 6:
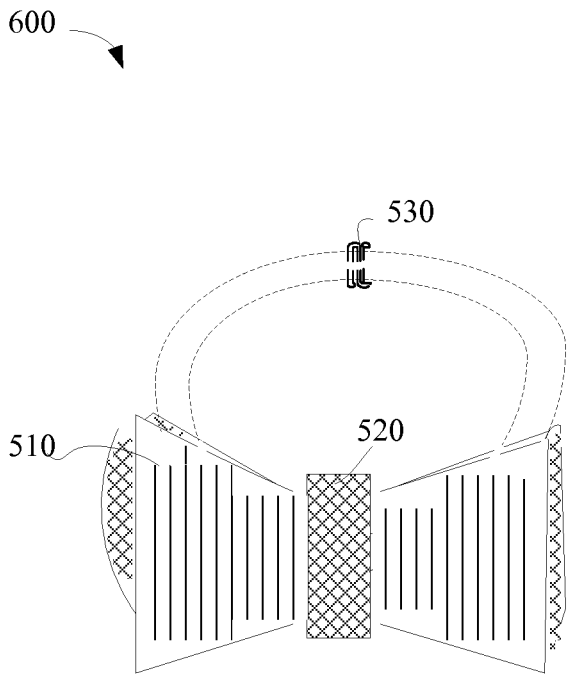
FIG. 6 is an example illustration of a tied assembled bow tie of FIG. 5.

FIG. 5 is an example illustration of an untied bow tie 500 including a first and second interchangeable tie section 510, 520, respectively, coupled by the connecting link 530. In accordance with the disclosed implementation, when the bow tie illustrated in FIG. 5 is tied, the leaf portion of the first tie section 510 is the front leaf of the tied bow tie, as illustrated in FIG. 6. FIG. 6 is an example illustration of the tied bow tie 600 of FIG. 5.

In accordance with the disclosed implementation, the interchangeable tie sections allow a wearer to increase the number of different bow ties in his wardrobe exponentially. For example, when the wearer has two (2) disclosed tie sections, the wearer has two different bow ties (i.e., two interchangeable tie section combinations) available. With three (3) disclosed tie sections, the wearer has six (6) bow ties available in his/her wardrobe. A wearer with four (4) interchangeable tie sections has twelve (12) bow ties available in the wearer's wardrobe.

In a retail setting, the disclosed interchangeable tie sections may be sold individually as well as in a pack. It is preferable that the retailer sell the interchangeable tie sections at least including a pack of three (3) tie sections, wherein two (2) of the included tie sections in the pack are tied in a bow tie. It is preferable that each tie section that is sold individually includes a link in the packaging.

Alternatively, the interchangeable tie sections may be sold in a pack of two, wherein the two interchangeable tie sections are coupled using a connecting link and tied as a bow tie in the packaging.

Although two examples are provided for retailing and packaging the disclosed interchangeable tie sections, these examples are not to limit how the interchangeable tie sections are sold in retail or otherwise.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A method for assembling a bow tie comprising: inserting a first open end of a connecting link, separate from a tie section, into a loop of a strap portion included in the tie section, the tie section further including a leaf portion, wherein the loop is one end of the first tie section;

selecting another tie section, the other tie section including a strap portion and a leaf portion, the other strap portion including a loop, wherein the other tie section loop is for inserting a second open end of the connecting link; and coupling the tie section with the other tie section by inserting the second open end of the connecting link into the loop of the other tie section; wherein the connecting link is an S shaped clip.

2. The method of claim 1, wherein the strap portions of the tie section and the other tie section include an adjusting clip for adjusting a length of each of the tie section and the other tie section.

3. The method of claim 1, wherein each of the tie section and the other tie section are each a half of a bowtie.

4. The method of claim 3, wherein the tie section and the other tie section are coupled together by the connecting link, such that when the bow tie is tied, the leaf portion of the tie section and the other tie section is one of a front leaf panel and back leaf panel respectively of the tied bow tie.

5. A bow tie comprising: a tie section including a strap portion and a leaf portion, the strap portion including a loop for inserting a first end of a connection link therein, wherein the loop is one end of the tie section; an another tie section, separate from the tie section, the other tie section including a strap portion and a leaf portion, the other strap portion including a loop of the other tie section, wherein the loop is one end of the other tie section; and the connecting like comprising a first open end inserted into the loop of the tie section; and a second open end inserted into the loop of the other tie section; wherein the connecting link is an S shaped clip.

6. The bow tie of claim 5 wherein the strap of the tie section and the other tie section include an adjusting clip for adjusting a length of each strap portion.

7. The bow tie of claim 1, wherein the tie section and the other tie section are each a half of a bowtie.

8. The bow tie of claim 7, wherein the tie section and the other tie section are coupled together by the connecting link, such that when the bow tie is tied, the leaf portion of the tie section and the other tie section is one of a front leaf panel and back leaf panel respectively of a tied bow tie.

* * * * *